United States Patent [19]

Cappelli

[11] 4,445,262

[45] May 1, 1984

[54] PROCEDURE FOR REBUILDING THE MOVABLE PLATE IN THE POURING VALVE OF A LADLE

[75] Inventor: Romano Cappelli, Milan, Italy

[73] Assignee: USS Engineers and Consultants, Inc., Pittsburgh, Pa.

[21] Appl. No.: 451,677

[22] Filed: Dec. 21, 1982

[30] Foreign Application Priority Data

Apr. 12, 1982 [IT] Italy ..... 25757 A/81

[51] Int. Cl.[3] ..... B23P 7/04

[52] U.S. Cl. ..... 29/402.08; 29/402.02; 164/437

[58] Field of Search ..... 29/402.08, 402.09, 402.11, 29/402.12, 402.14, 402.15, 402.17, 402.01, 402.02, 402.04, 402.03, 402.05, 402.06, 402.07, 403.1, 403.3, 527.3, 527.7; 164/66, 268, 269, 417, 443, 444, 259, 415, 475, 476, 485, 461

[56] References Cited

U.S. PATENT DOCUMENTS 4,092,771 6/1978 Tinnes et al. ..... 29/402.08

*Primary Examiner*—Mark Rosenbaum
*Assistant Examiner*—V. K. Rising
*Attorney, Agent, or Firm*—John F. Carney

[57] ABSTRACT

Procedure for rebuilding a movable plate in the pouring valve of a ladle, involving the complete reconstruction of the original nozzle, which has been removed, and of a flat portion, also removed, around the pouring hole, in a circular or rectangular area whose width is equal to at least the external diameter of the nozzle. The nozzle is reconstructed with a prefabricated piece of refractory material, or with fresh refractory material packed "in situ", and may be of the same shape as the original nozzle, or of a different shape; the flat portion is reconstructed using a prefabricated refractory piece, or with fresh refractory material packed "in situ".

4 Claims, 6 Drawing Figures

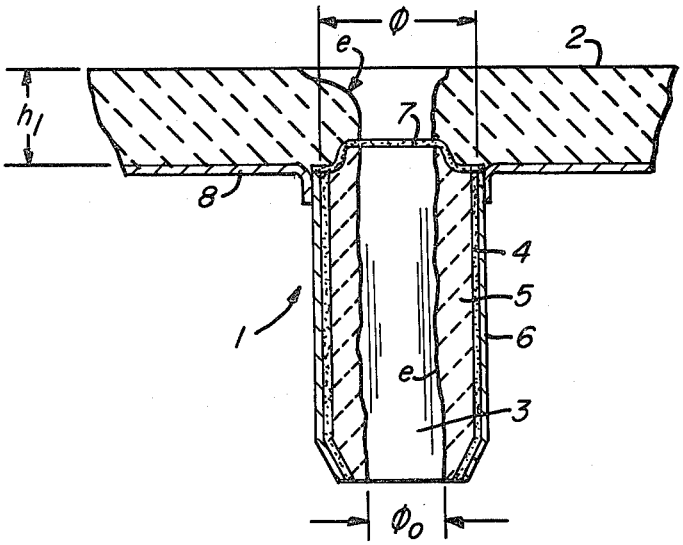
FIG. 1
FIG. 2
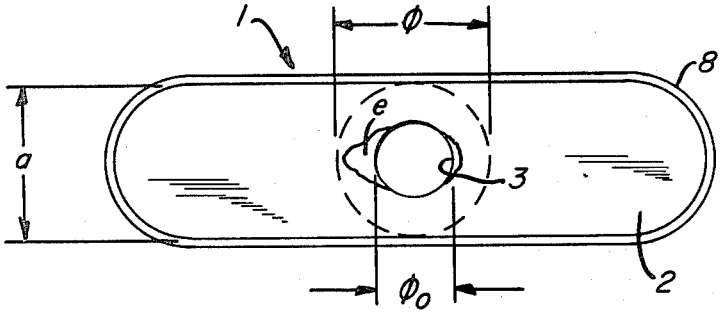
FIG. 3
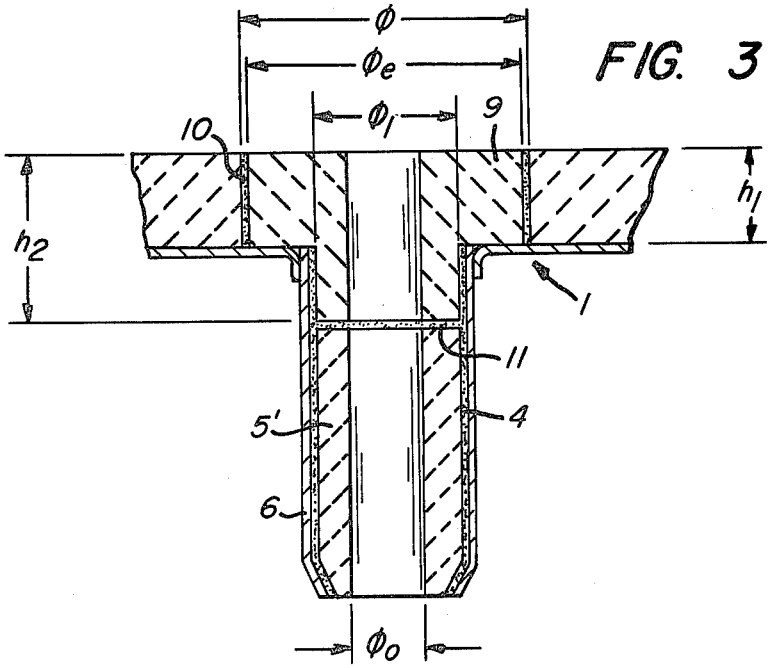

PROCEDURE FOR REBUILDING THE MOVABLE PLATE IN THE POURING VALVE OF A LADLE

BACKGROUND OF THE INVENTION

This invention concerns a procedure for rebuilding a movable plate used in the pouring valve of a teeming vessel, such as a ladle.

The considerable cost of plates for pouring valves in ladles, and the fact that heavy wear experienced by these plates requires that they frequently be replaced, have led manufacturers and users to study methods for rebuilding a worn plate. Several methods are known for performing this rebuilding, and the applicant himself is the owner of Italian Patent Application No. 23,358 A/80, which describes a method for rebuilding.

The known methods have the drawback of reconstructing the movable plate in a rather restricted area around the pouring hole, meaning that the lifetime of a refurbished plate is limited. Hereafter, we shall call the movable plate simply the "plate". It is to the improvement of such methods of plate reconstruction that the present invention is directed.

SUMMARY OF THE INVENTION

The procedure outlined in the present invention consists of the reconstruction of the plate with appropriate refractory material in a wide area around the pouring hole in the flat portion of the plate and complete reconstruction of the "nozzle". This procedure is performed according to the various methods which, however, all have in common certain preliminary operations which are already known (selection of a plate which is suitable for rebuilding, removal of metal particles and slag, testing and possible restoration of flatness, etc.) and then removal of a circular, square, or rectangular element of the flat part of the plate around the pouring hole (hereafter, we shall refer to the removed element of the flat part of the plate, and to the corresponding reconstructed element, as the "upper element"), and removal of the refractory nozzle from its socket in the metal casing. The upper element may be cut out by reaming out the hole or with the use of a milling cutter or saw, and the nozzle may be removed by pressing it through the aperture left by the above-mentioned upper element by means of a press. The upper element is cut out to a diameter $\phi$ or width L which should at least equal the diameter of a circle smaller than the thickness of the refractory putty in position around the nozzle, i.e., between the metal casing of the nozzle and the refractory nozzle itself (hereafter simply called "nozzle"). This cut may be made to a diameter or length compatible with the minimum transverse dimension of the plate.

After removal of the upper element and the nozzle, according to the first method of performing the procedure, an upper element is separately fabricated, with a stepped profile, for example, a ring consisting of stepped parts of different external diameters, an upper part with an external diameter $\phi_e$ slightly smaller than the diameter $\phi$ as defined above, so as to allow the interposition according to the known technique of a layer of refractory putty, and a lower part with an external diameter the same as the external diameter of the nozzle; separately, a nozzle is fabricated which is similar to the original, but shorter, to allow for the above-mentioned lower annular portion of the stepped ring and for the thickness of a layer of refractory putty which is placed between the ring and the nozzle. The plate is then rebuilt by first installing the new nozzle into its socket in the casing, and then, after applying the above-mentioned layer of refractory putty, according to the known technique, by installing the above-mentioned stepped ring.

Alternatively, this method of rebuilding the plate may be performed by packing fresh castable refractory material "in situ" according to the known technique, rather than by using a new nozzle and a new, prefabricated, upper element.

In a further method of performing the procedure, a single piece of refractory material consisting of the nozzle and the upper element with outside diameter $\phi_e$ as defined above is separately fabricated. This piece is then installed in the socket created by the removal of the above-mentioned parts, after application, where necessary, of a layer of refractory putty, according to the known technique.

A third method of performing the procedure is a variant of the first, and consists of the fabrication of an upper element which has on its lower surface the same concavity as the original part, corresponding to the nozzle. Therefore, the nozzle, whether prefabricated or packed "in situ", has, with this third method, a convex upper surface which fits into the above-mentioned concavity; provision must still be made for placing a layer of refractory putty between the abovementioned parts according to the known technique.

In all the methods described, the upper element is of such a thickness that once it has been installed in a plate, a small portion of it projects above the plate itself; this is then removed by machining so as to yield an upper surface for the plate which is plane and smooth.

The layer of refractory putty between the nozzle and the corresponding casing is not usually damaged when the nozzle is removed from the worn plate; if this layer should be damaged in whole or in part, it should be repaired according to the known technique. Finally, the diameter of the hole in the reconstructed parts should preferably be the same as in the original part.

The advantages of the process of the invention include the fact that the reconstructed parts may be very thick in the radial direction, and consequently may also have a long lifetime; furthermore, with the second method described, the insertion of a single piece in the plate prevents dangerous gaps between different parts within the pouring hole; while with the third method described, the same fabricated nozzles may be used to construct new plates.

BRIEF DESCRIPTION OF THE DRAWINGS

To give a better understanding of the process of the invention, the three methods of realizing the process will be described, solely as examples, with reference to the schematic drawings attached, wherein:

FIG. 1 is a partial vertical section of a worn plate selected for rebuilding;

FIG. 2 is a top view of the upper surface of a worn plate;

FIG. 3 is a partial vertical section of the plate in FIG. 1, rebuilt according to the first method;

DESCRIPTION OF THE PREFERRED EMBODIMENTS OF THE INVENTION

Figure 4:
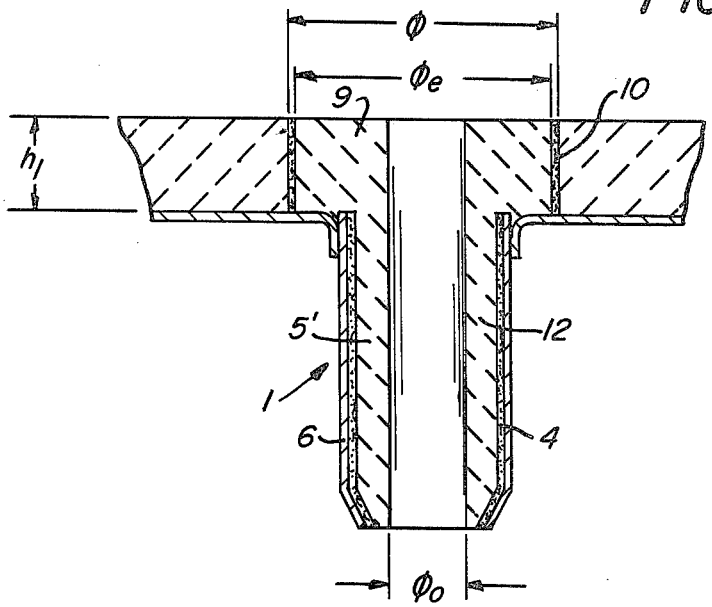
FIG. 4 is a partial vertical section of the plate in FIG. 1, rebuilt according to the second method.

FIG. 1 shows the erosion e produced by the flow of steel on the surface 2 of the plate 1 around the pouring hole 3, and inside the pouring hole 3 of diameter $\phi_0$. The smallest diameter $\phi$ to which a ring can be cut for extraction from the flat portion of the plate must fit within the thickness of the layer of refractory putty 4 between the nozzle 5 and the corresponding casing 6. In the flat portion of the plate 1, the refractory material contained within the casing 8 has a thickness $h_1$, and in the area around the pouring hole 3 and in the contact area between the nozzle and the flat portion, the concavity of the flat portion and the corresponding convexity of the nozzle are visible, separated by the layer of refractory putty 7.

FIG. 2 shows the pouring hole 3, with diameter $\phi_0$, and the minimum transverse dimension a of the refractory material of the plate 1 within its casing 8. This will make it clear that the largest diameter $\phi$ to which a ring to be extracted from the above-mentioned flat portion can be cut may be very close or equal to a. On surface 2 may be seen the erosion e, which is more extensive on the left-hand side of the hole 3.

FIG. 3 shows that, once a ring of external diameter $\phi$ and the nozzle have been extracted from the flat portion of the plate 1, plate 1 has been rebuilt by installing a prefabricated nozzle 5' inside the casing 6, and by subsequently installing a stepped ring 9 with upper external diameter $\phi_e$, 2 mm less than $\phi$, and lower external diameter $\phi_1$ corresponding to the external diameter of the nozzle. The height $h_2$ of the ring 9 is twice $h_1$.

FIG. 4 shows a solid piece 12, consisting of an uppper part 9' and a nozzle 5', as it appears after installation in the space left free by the removal of the ring and the old nozzle. In this case, too, the external diameter $\phi_e$ of the upper part of the piece 12 is 2 mm smaller than $\phi_e$.

Figure 5:
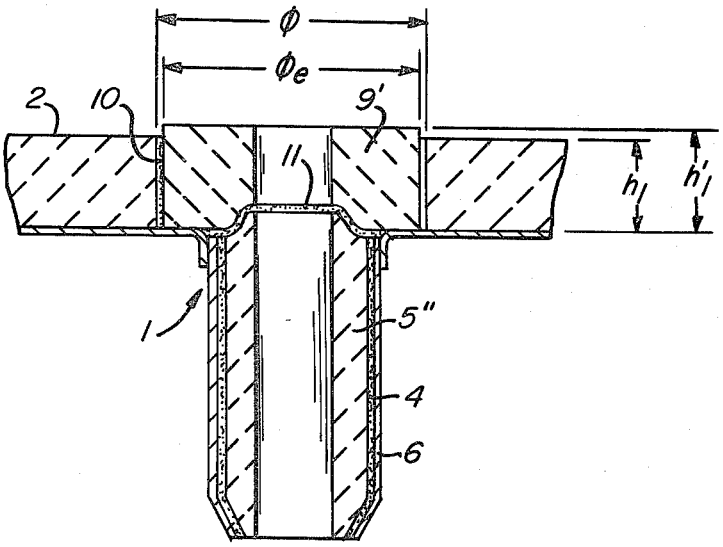
FIG. 5 is a partial vertical section of the plate in FIG. 1, rebuilt according to the third method.

FIG. 5 shows that in plate 1 a new prefabricated nozzle 5'' is installed first, of the same size e as the original nozzle, and that a ring 9' is placed ontop of this nozzle 5'', the ring having the same external diameter $\phi_e$ already defined and the same concavity next to the nozzle as the original plate had. It also shows that ring 9' is constructed with height $h'_1$, so that the more heavily shaded projecting portion $h'_1-h_1$ may be removed by an appropriate milling machine after the application of the ring of the plate, so as to give the best degree of flatness and smoothness of the upper surface 2. This device, although not indicated on the other figures, is used on all the methods of performing the process of the invention.

Figure 6:
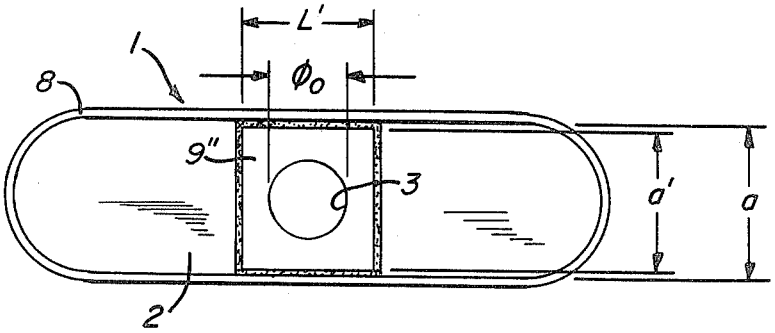
FIG. 6 is a top view of a plate rebuilt according to an alternative to the three methods described.

FIG. 6 shows a rebuilt plate 1, in which the upper element 9'' has a rectangular shape with width L' and length a'. The symbols 8 and $\phi$ indicate, respectively, the casing of the flat portion of the plate and the diameter of the pouring hole.

In FIGS. 3, 4, 5 and 6, there are indications of layers of refractory putty (4, 10, 11), which are designed to be applied according to known techniques and which therefore are not the object of the claims.

Finally, it must be understood that the procedure illustrated up to now as a procedure for rebuilding worn plates may also be applied, by the use of obvious variations, to the construction of new plates; this would have the advantage of providing for the saving of considerable amounts of high-quality refractory material. This material can then be used for the construction of the nozzle and the upper element, while the remaining portion of the plate may be made of more economical material.

What is claimed is:

1. Procedure for rebuilding a movable plate in the pouring valve of a ladle, according to which the portions around the pouring hole are removed and rebuilt using suitable prefabricated parts of refractory material, or packed directly "in situ" to replace the parts removed; characterized by the fact that it consists of the removal of an upper element of the flat part of the plate (1) over an area ($\phi$, L) which is greater in width than the diameter that fits within the thickness (4) of the refractory putty placed between the nozzle (5) and its casing (6), and less than the minimum width (a) of the plate (1); removal of the nozzle (5); replacement of the nozzle thus removed (5) with a nozzle (5'), which is either prefabricated or packed "in situ", with a height less than that of the nozzle that was removed (5); replacement of the upper element that was removed with a stepped upper element (9, 9'') which has an upper width ($\phi_e$, L') slightly smaller than the width ($\phi$, L) of the upper element that was removed to allow for the interposition of a layer (10) of refractory putty, and with a lower annular part with an external diameter ($\phi_1$) corresponding to the external diameter ($\phi_1$) of the nozzle (5') and with a total height ($h_2$) greater than the height ($h_1$) of the flat part of the plate (1).

2. Procedure for rebuilding the movable plate in the pouring valve of a ladle, according to which the portions around the pouring hole are reconstructed with parts which replace the parts removed and are prefabricated from suitable refractory material or are packed directly "in situ", characterized in that it consists of the removal of an upper element of the flat part of the plate (1) over an area ($\phi$, L), which is greater in width than the diameter that fits within the thickness (4) of the refractory putty placed between the nozzle (5) and its casing (6) and is less than the minimum width (a) of the plate (1); removal of the nozzle (5); replacement of the removed nozzle and upper element by a single piece (12) prefabricated or packed "in situ", consisting of a nozzle (5') and an upper part (9') with a width ($\phi_e$, L') slightly smaller than the width ($\phi$, L) of the upper element that was removed to allow for the interposition of a layer (10) of refractory putty.

3. Procedure for rebuilding the movable plate in the pouring valve of a ladle, according to which the portions around the pouring hole are reconstructed with parts which replace the parts removed and are prefabricated from suitable refractory material or packed directly "in situ", characterized in that it consists of the removal of an upper element of the flat portion of the plate (1) over an area ($\phi$, L) which is greater in width than the diameter that fits within the thickness (4) of the refractory putty placed between the nozzle (5) and its casing (6) and is less than the diameter which fits within the minimum width (a) of the plate (1); removal of the nozzle (5); replacement of the nozzle which has been removed (5) by a similar nozzle, either prefabricated or packed directly "in situ"; replacement of the upper element which was removed by an upper element (9') which has a width ($\phi_e$, L') slightly smaller than the width ($\phi$, L) of the upper element which was removed to allow for the interposition of a layer (10) of refractory putty.

4. Procedure according to any of the preceding claims, characterized in that the upper element (9, 9', 9'') installed in the flat portion of the plate (1) to replace the upper element that was removed initially projects above the upper surface of said flat portion and is subsequently smoothed off to the level of said upper surface.

* * * * *